US008057124B2

(12) United States Patent
Stenzel et al.

(10) Patent No.: US 8,057,124 B2
(45) Date of Patent: Nov. 15, 2011

(54) METHOD AND DEVICE FOR MEASURING SOIL PARAMETERS BY MEANS OF COMPACTION MACHINES

(75) Inventors: Otto W. Stenzel, Herrsching (DE); Stefan Wagner, Bad Honnef (DE); Dittmar Lange, Munich (DE)

(73) Assignee: Wacker Neuson Produktion GmbH & Co. KG, Munich (DE)

( * ) Notice: Subject to any disclaimer, the term of this patent is extended or adjusted under 35 U.S.C. 154(b) by 553 days.

(21) Appl. No.: 12/280,391

(22) PCT Filed: Feb. 19, 2007

(86) PCT No.: PCT/EP2007/001419
§ 371 (c)(1),
(2), (4) Date: Oct. 14, 2008

(87) PCT Pub. No.: WO2007/096118
PCT Pub. Date: Aug. 30, 2007

(65) Prior Publication Data

US 2009/0166050 A1 Jul. 2, 2009

(30) Foreign Application Priority Data

Feb. 22, 2006 (DE) ..... 10 2006 008 266

(51) Int. Cl.
*G01N 3/00* (2006.01)
*E01C 19/38* (2006.01)

(52) U.S. Cl. ..... 404/117; 702/2; 73/784

(58) Field of Classification Search ..... 73/784; 172/40; 404/72, 133.1
See application file for complete search history.

(56) References Cited

U.S. PATENT DOCUMENTS

| | | | | |
|---|---|---|---|---|
| 6,213,681 | B1 * | 4/2001 | Sick et al. | 404/133.05 |
| 6,619,125 | B2 * | 9/2003 | Laugwitz | 404/133.05 |
| 6,752,567 | B2 * | 6/2004 | Miyamoto et al. | 404/117 |
| 6,808,336 | B2 * | 10/2004 | Fervers et al. | 404/133.1 |
| 6,846,128 | B2 * | 1/2005 | Sick | 404/133.05 |

FOREIGN PATENT DOCUMENTS

| | | | |
|---|---|---|---|
| DE | 23 22 469 | A1 | 11/1974 |
| EP | 1 561 961 | A | 3/2005 |

* cited by examiner

*Primary Examiner* — Lisa Caputo
*Assistant Examiner* — Jonathan Dunlap
(74) *Attorney, Agent, or Firm* — Boyle Fredrickson, S.C.

(57) ABSTRACT

A soil compaction device has a vibrated contact element that makes contact with the soil during a contact phase and that is exposed to a contact force exerted by the soil and travels over a contact distance. A dynamic stiffness of the soil is formed from the gradient of the contact force and from the contact distance. Furthermore, a contact surface parameter to take account of the actual contact surface of the contact element with the soil is determined. The dynamic deformation modulus is then the product of the contact surface parameter and the dynamic stiffness. The method allows the determination of the dynamic deformation modulus, and hence of the soil stiffness, during the compaction operation.

31 Claims, 9 Drawing Sheets

Fig. 1
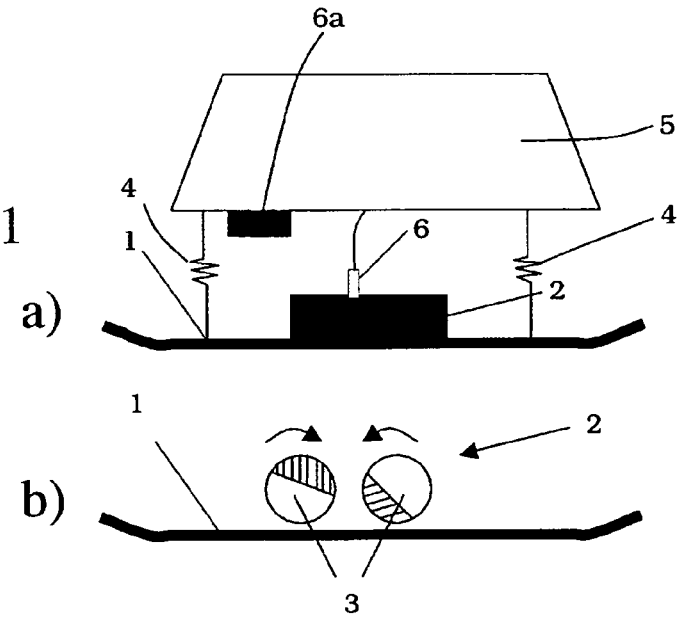
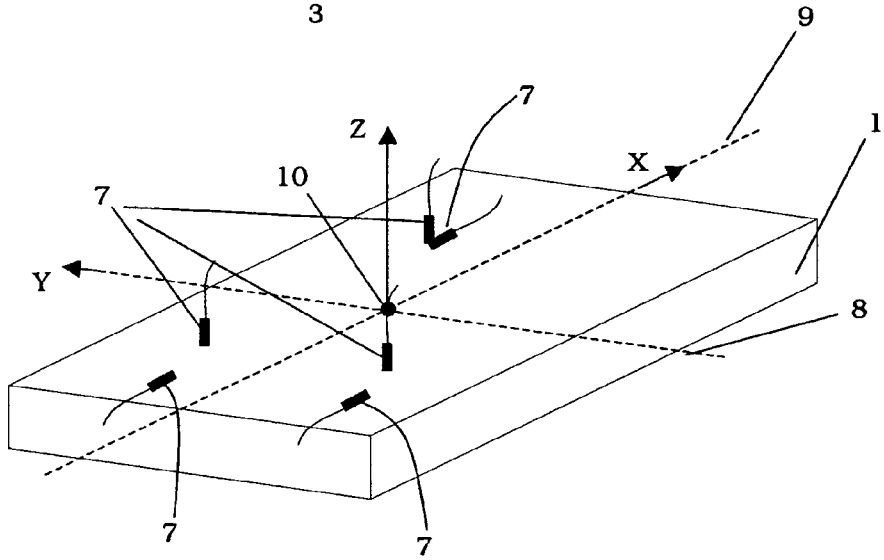
Fig. 2

METHOD AND DEVICE FOR MEASURING SOIL PARAMETERS BY MEANS OF COMPACTION MACHINES

BACKGROUND OF THE INVENTION

1. Field of the Invention

The present invention relates to a method for determining a soil parameter using a soil compaction device that has a contact element that is charged with vibration for soil compaction.

2. Description of the Related Art

Vibrating plates and vibrating tampers, as well as vibrating rollers, are known for use as soil compaction devices. Each of these has at least one soil contact element that is charged with vibration by a vibration exciter and that introduces the vibration into the soil in order to achieve a compaction effect.

In order to monitor the quality of compaction work, it is helpful to determine particular soil parameters, such as for example soil rigidity, deformability, load capacity, etc.

In order to determine soil parameters, methods and devices are known that operate separately from soil compaction devices. Thus, there is a standardized plate load method (DIN 18134) in which a modulus of deformation $E_v$ is determined in the context of a static load plate pressure test. Likewise, a dynamic load plate pressure test is known Technical test specifications for soil and rock in roadway construction, TP BF-StB, Part B, 8.3 (1997)).

Conventional measurement methods and devices separate from the compaction devices require a significant additional expense, because in addition to the compaction device measurement devices must also be made available, which generally require a correspondingly trained operator. Moreover, the number of measurements on a given surface is limited by time constraints; i.e., only some spot samples can be measured.

On the other hand, methods are also known in which special soil compaction devices are themselves used to measure, in particular, soil rigidity and/or moduli of deformation of the soil, these parameters being the central criteria for successful compaction. Such devices and methods are known for example from DE 27 10 811 C2, WO 98/17865, DE 29 42 334 C2, and EP 1 164 223 A1. Each of these publications indicates vibrating rollers that are moved over the soil that is to be compacted, and that draw conclusions concerning the soil rigidity on the basis of the vibration characteristics of the roller drum (roller tire).

As a rule, vibrating rollers are operated in such a way that the roller tires that act as the soil contact element do not lift off from the soil even when charged with vibration. As a whole, the roller tires move periodically, resulting in a relatively uniform amplitude movement of the roller tires. In contrast, the known measurement methods and devices are not suitable for other soil compaction devices, in particular vibrating plates or tampers. Vibrating plates and vibrating tampers standardly do not make contact with the soil during a significant part of a vibration-load cycle. Here, contact times have been determined that make up only about 10% of the overall vibration period. The measurement methods described above, used with vibrating rollers, are geared towards measuring signals that result from a largely constant state. Even if the roller tires jump off the soil, these airborne phases are relatively short, so that the influence of the error is low.

In contrast, in the case of tampers and vibrating plates long airborne phases and short contact times must be assumed, so that the measurement methods known from the prior art, which are geared toward a periodic movement characteristic, are not suitable. In addition, the soil contact elements of vibrating plates and tampers are subject to a rather chaotic movement characteristic, because they constantly have to absorb soil forces at different places due to the jumping or airborne phases.

OBJECT OF THE INVENTION

The object of the present invention is to indicate a method for determining soil parameters that is also suitable for soil compaction devices whose soil contact element repeatedly lifts off from the soil, in particular even for those devices in which the airborne phase is fairly long relative to a vibration cycle. The method should permit a determination of the soil parameters whenever, independent of its particular movement characteristic and/or contact behavior, the soil compaction device makes contact with the soil during an excitation cycle. Preferred applications are soil compaction devices having fairly chaotic movement patterns, such as in particular vibrating plates and tampers.

According to the present invention, this object is achieved by a method according to patent claim 1. A soil compaction device that uses the method is defined in Claim 29. Advantageous further developments of the present invention are indicated in the dependent claims.

A method according to the present invention is used to determine a soil parameter by means of a soil compaction device that has a contact element that is charged with vibration for soil compaction. During a contact phase, the contact element is in contact with the soil, and is thus exposed to a contact force $F_{contact}$ exerted by the soil, and travels a contact path $s_{contact}$. In the following, contact force $F_{contact}$ is also referred to simply as contact force F, and contact path $s_{contact}$ is referred to simply as contact path s.

The soil compaction device can be a vibrating plate or a vibrating tamper. It has a lower mass that comprises the contact element and an upper mass that standardly comprises a drive. The lower mass is coupled to the upper mass via a spring device. A vibration exciter that charges the contact element can also be a component of the lower mass, for example in a vibrating plate. In a vibration tamper, the vibration exciter operates by means of a path excitation, e.g. a crank mechanism situated between the upper mass and the lower mass.

The soil parameter that can be determined by the method according to the present invention is designated as dynamic modulus of deformation $E_{v,dyncompaction}$, and is determined using the equation:

$$E_{v,dyncompaction} = \alpha - \frac{\Delta F_{contact}}{\frac{\Delta s_{contact}}{k_{dyn}}} \tag{1}$$

Here, $\Delta F_{contact}/\Delta s_{contact}$ represents an approximation (averaging) of the actual gradient of the contact force $dF_{contact}/ds_{contact}$. $\alpha$ is a contact surface parameter that takes into account the geometry and shape of the actual contact surface of the contact element with the soil during a particular time segment used for the determination of the actual contact surface.

On the basis of the dynamic modulus of deformation $E_{v,dyncompaction}$, a dynamic shear modulus $G_{v,dyncompaction}$ can be calculated, taking into account soil-dependent parameters (transverse contraction index $\upsilon$) if warranted.

Soil contact parameter $\alpha$, which expresses the influence of the actual contact surface as a geometric factor, is discussed in more detail below. Because the contact surface active during a load cycle, and also the contact force and the relevant contact path, can change from cycle to cycle both in their direction and in their magnitude, contact surface parameter $\alpha$, as well as the contact force and the contact path, are determined during each load phase, i.e. during each load cycle.

The factor $k_{dyn}$ represents the dynamic rigidity of the soil, and is formed as a gradient of contact force F and contact path s. The dynamic rigidity $k_{dyn}$, which can also change within the load phase, is determined during each load phase in order to enable precise monitoring of the rigidity of the soil during the compaction process.

In order to determine the dynamic rigidity $k_{dyn}$, first the contact force and the contact path traveled by the contact element during the contact phase must be determined.

Preferably, the components of the contact force F in the three spatial directions are determined from the center of mass principle, relative to a coordinate system fixed in the center of gravity of the contact element. Alternatively, the components can also be determined for a stationary coordinate system, e.g. relative to the soil.

In the case of a moving coordinate system, the resultant acceleration components result from the sum of the externally acting forces in the z direction, in accordance with:

$$m_U(\ddot{x}_S-\dot{y}_S\cdot\dot{N}+\dot{z}_S\cdot\dot{\Phi})=\Sigma F_X$$

$$m_U(\ddot{y}_S-\dot{z}_S\cdot\dot{X}+\dot{x}_S\cdot\dot{N})=\Sigma F_Y$$

$$m_U(\ddot{z}_S-\dot{x}_S\cdot\dot{\Phi}+\dot{y}_S\cdot\dot{X})=\Sigma F_Z \quad (2)$$

where $\dot{\Phi}$, $\dot{X}$, $\dot{N}$ represent the corresponding rotational speeds in the pitch direction (about the y axis), the roll direction (about the x axis), and the yaw direction (about the z axis), and $m_u$ represents the mass of the contact element. $\dot{x}_S$, $\dot{y}_S$, $\dot{z}_S$ represent the respective translational speeds in the center of gravity of the contact element, while $\ddot{x}_S$, $\ddot{y}_S$, $\ddot{z}_S$ represent the corresponding accelerations.

The forces acting on the lower mass are composed (with i=x,y,z) from the respective force components on the basis of an imbalance excitation $F_{ECC,i}$, from the resultant contact force to the soil $F_{C,i}$, from the internal forces to the rest of the machine (e.g., the upper mass of the soil compaction device) $F_{U,i}$, and from the components of the weight of the contact element. The sum of the acting forces can therefore be indicated as follows for the individual spatial directions:

$$\Sigma F_X=F_{C,X}+F_{ECC,X}+F_{U,X}-m_U g\cdot\sin(\Phi)\cdot\cos(X)$$

$$\Sigma F_Y=F_{C,Y}+F_{ECC,Y}+F_{U,Y}+m_U g\cdot\cos(\Phi)\cdot\sin(X)$$

$$\Sigma F_Z=F_{C,Z}+F_{ECC,Z}+F_{U,Z}-m_U g\cdot\cos(\Phi)\cdot\cos(X) \quad (3)$$

where $F_{C,i}$ is a contact force of contact element (1) to the soil, $F_{U,i}$ is an internal force between contact element (1) and the rest of the machine (upper mass), $m_u$ is the mass of the contact element, $F_{ECC,i}$ is the exciting force of a vibration exciter that excites the contact element, and $\Phi$ and X represent the corresponding pitch or roll angle.

If the two equation systems (2) and (3) above are set equal to each other, and solved for the respective contact force components, the following results:

$$F_{C,x}=m_U(\ddot{x}_S-\dot{y}_S\cdot\dot{N}+\dot{z}_S\cdot\dot{\Phi})-F_{ECC,x}-F_{U,x}+m_U g\cdot\sin(\Phi)\cdot\cos(X)$$

$$F_{C,y}=m_U(\ddot{y}_S-\dot{z}_S\cdot\dot{X}+\dot{x}_S\cdot\dot{N})-F_{ECC,y}-F_{U,y}-m_U g\cdot\cos(\Phi)\cdot\sin(X)$$

$$F_{C,z}=m_U(\ddot{z}_S-\dot{x}_S\cdot\dot{\Phi}+\dot{y}_S\cdot\dot{X})-F_{ECC,z}-F_{U,z}+m_U g\cdot\cos(\Phi)\cdot\cos(X) \quad (4)$$

The overall resultant contact force can then be calculated from the individual components $F_{C,i}$ by corresponding vectorial determination of the amplitude and direction of the overall acting contact force from the partial components.

The method according to the present invention can be used for example in a vibrating plate or a vibrating tamper. Because in such devices the contact force acts predominantly normal to the contact surface, the contact force portion in the contact normal direction, i.e. in the direction of the z axis, is preferably determined by evaluating the impulse balance in this direction.

The contact force can then for example be determined, as a simplification, as $$F_{C,Z}=m_U\ddot{z}_S-F_{ECC,Z} \quad (5)$$

where $m_u$ is the mass of the contact element, $\ddot{z}_S$ is the acceleration of the contact element in the direction of the contact normal (z axis), and $F_{ECC,Z}$ is the exciting force of a vibration exciter that charges the contact element.

In order to determine the translational accelerations and the rotational accelerations: The translational acceleration $\ddot{x}_S$, $\ddot{y}_S$, $\ddot{z}_S$ of the contact element in the center of gravity can be measured for example by an acceleration sensor provided on the contact element itself. As an acceleration sensor, for example a triax sensor attached at the center of gravity, for measuring all three spatial directions simultaneously, is suitable. The translational speed components $\dot{x}_S$, $\dot{y}_S$, $\dot{z}_S$ in the three spatial directions can then be determined for example by simple integration of the acceleration signals.

Alternatively, if for example as a result of the design a sensor cannot be attached at the center of gravity, the translational acceleration of the center of gravity in the three spatial directions (x, y, z), as well as the rotational acceleration about the three axes x, y, z, can also be determined using at least six acceleration sensors. These are preferably distributed around the center of gravity of the contact element in such a way that with regard to their measurement direction, each of three acceleration sensors is attached to the contact surface in the direction of a normal (z direction), but as far as possible these three sensors are not situated on a single line. Three additional acceleration sensors are situated such that they also are not situated on a single line, but are attached in the direction of a tangent to the contact surface, with respect to their direction of measurement.

Both the desired translational accelerations and the rotational accelerations can now be determined from the kinematic relation between acceleration at the center of gravity and the acceleration measured at an arbitrary point of the body, given existing, i.e. measured, rotational accelerations $\ddot{\Phi}$, $\ddot{X}$, $\ddot{N}$. The required angles of rotation $\Phi$ and X can then be determined by double integration of the rotational accelerations $\ddot{\Phi}$, $\ddot{X}$.

In some cases of application, it can be sufficient to reduce the number of required sensors because some degrees of freedom are not present due to the design. Thus, the contact element of a vibrating tamper, i.e. its soil contact plate, executes a movement mainly in a translational direction, namely the direction of the normal to the contact (z axis), due for example to the parallel guiding of the tamper foot. Accordingly, for this application in some circumstances the use of a single acceleration sensor on the contact element is sufficient. If warranted, additional movement components can be determined using measurement sensors on the upper mass.

Another alternative is to determine the acceleration components in the direction of the contact normals in contactless fashion, e.g. using optical laser sensors. The sensors are then preferably provided not on the contact element, but rather on an upper mass that is connected to the contact element via a spring device. The upper mass can for example also comprise a drive motor for the soil compaction device, in a known manner. With the aid of the sensors, for example a change of distance between the upper mass and the contact element can be measured, so that, given knowledge of the position and orientation of the upper mass, the accelerations of the contact element in the contact normal direction at the corresponding measurement points can be determined by double differentiation.

Finally, radar sensors can also be used to determine the speed of the contact element relative to the upper mass, e.g. on the basis of the Doppler effect, or else on the basis of the distance, for example using interference radar, which also makes possible a calculation of the accelerations as described above.

In order to determine the exciting force $F_{ECC}$:

In a specific embodiment of the present invention, the exciting force $F_{ECC}$ coming from the vibration exciter can be measured by a force measurement device provided between the vibration exciter and the contact element. A suitable force measurement device is for example a force measurement cell attached below the vibration exciter.

Alternatively, the exciting force $F_{ECC}$ can also be calculated from the momentary position of the exciter imbalance masses. For the case in which the vibration exciter has two shafts rotating in opposite directions, each having equally large imbalance masses, and whose axes of rotation have the same orientation as the y axis of the contact element and whose phase position to one another is adjustable, the components of the exciting force $F_{ECC}$ relative to the stationary coordinate system on the contact element are calculated in simplified fashion, as a function of time t, using the following equations:

$$F_{ECC,X}(t)=EM\cdot\Omega^2\sin(\phi_{Phase}/2)\cdot\cos(\Omega\cdot t)$$

$$F_{ECC,Y}(t)=0$$

$$F_{ECC,Z}(t)=EM\cdot\Omega^2\cos(\phi_{Phase}/2)\cdot\cos(\Omega\cdot t) \quad (6)$$

where EM is the resultant mass of a rotating imbalance mass, $\Omega$ is the exciting frequency of the vibration exciter, and $\phi_{Phase}$ represents the phase angle between the two imbalance masses.

Thus, the direction and magnitude of the momentarily acting imbalance force can be determined from the momentary position of the imbalance masses, as well as the knowledge of the angular speed of the exciter shafts and the size of the imbalance mass.

The exciting force $F_{ECC}$ can of course also be calculated in vibration exciters having a different design. As a rule, it is represented as a function of time t, but can also be made a function of the phase position or angular position of the relevant imbalance masses.

For the case of the above-mentioned vibrating plate or vibrating tamper, in order to determine the exciting force $F_{ECC}$ it is possible for example to make the calculation exclusively using the component $F_{ECC,Z}$ acting in the direction of the contact normal, because for this purpose only the excitation in the direction of the z-axis, i.e. the direction of the normal to the contact surface, is significant.

The phase angle $\phi_{Phase}$, i.e. the relative phase position of the two imbalance masses to each other, is variable as a function of the user setting. The position of the imbalance masses can for example be determined using proximity sensors (inductive sensors or Hall sensors). The angular speeds of the imbalance shafts can then also be determined from the positions of the imbalance masses.

The internal forces $F_{U,i}$ between the contact element and the rest of the machine can be determined for example by force measurement cells situated between the contact element and, for example, the upper mass of the soil compaction device.

In order to determine the contact path s:

The contact path s required for the determination of the dynamic rigidity $k_{dyn}$ is determined at the times at which the contact element transmits soil contact forces, preferably in the vicinity of or at the resultant force application point, because the path of the force application point is the most closely connected to the change of the acting contact force. The determination of the position of the force application point is described in more detail below.

In order to determine the contact path, first the accelerations of the force application point are determined. Through double integration of the accelerations at the force application point, the amplitude and direction of the path at the force application point (contact path) can then be determined.

Accordingly, it is first necessary to determine the position of force application point P, which is explained in more detail below in connection with the calculation of contact surface parameter $\alpha$. Given the position, determined in this way, of the force application point $\overrightarrow{SP}=[SP_x, SP_y, SP_z]^T$ (relative to a coordinate system in center of gravity S), the acceleration at force application point $\vec{a}_p$ can be determined from the kinematic equations, according to:

$$\vec{a}_P=\vec{a}_S+\vec{\omega}\times\overrightarrow{SP}+\vec{\omega}\times(\vec{\omega}\times\overrightarrow{SP}) \quad (7)$$

As described above, the vector $\vec{\omega}=[\dot{\Phi}, \dot{X}, \dot{N}]^T$ of the rotational speeds and of the rotational accelerations $\vec{\omega}=[\ddot{\Phi}, \ddot{X}, \ddot{N}]^T$, as well as the translational acceleration at the center of gravity $\vec{a}_S=[\ddot{X}_S, \ddot{Y}_S, \ddot{Z}_S]$, can be determined using suitable sensors, which can for example be situated on the contact element. Preferably, however, only the contact path in the direction of the resultant contact force is taken into account for the evaluation.

If, for example, the contact force in a vibration plate acts predominantly normal to the contact surface, the contact path at the location of the force application point in the contact normal direction is preferably determined by evaluating the translational and rotational movement components. The evaluation of equation (7) for the component of acceleration at point P (force application point) in the z direction yields (ignoring the yaw movement; i.e. $\ddot{N}=\dot{N}=0$):

$$a_{P_z}=\ddot{z}_S+\ddot{X}\cdot SP_Y-\ddot{\Phi}\cdot SP_X-(\dot{\Phi}^2+\dot{X}^2)SP_Z \quad (8)$$

Double integration of $a_{P_z}$ then yields the desired contact path s in the contact normal direction.

For the determination of the translational or rotational movement components, as already described above, for example three acceleration sensors are situated on the contact element in such a way that they do not lie on one line, but are attached so that their measurement direction lies in the direction of a normal to the contact surface.

In this way, for various measurement times a plurality of measurement point pairs can be formed from contact force F and associated contact path s.

In this way, for various points in time information is provided in a particularly advantageous manner about contact force F and the associated contact path s, so that for each point in time a measurement point pair can be formed of contact force F and contact path s.

Preferably, those measurement point pairs are determined that occur during a load phase, during which the contact element is increasingly pressed against the soil. In this context, measurement point pairs that occur during a relief phase, in which the load on the contact element is lessening, or an airborne phase, in which the contact element is in the air without touching the soil, are excluded from further evaluation.

For each of the measurement point pairs of the load phase, a gradient $dF_{contact}/ds_{contact}$ is formed that corresponds to the dynamic rigidity $k_{dyn}$ at that point in time. The gradient dF/ds can also be formed as a ratio of two temporal changes (of the force and of the path).

Preferably, however, the gradients used for the respective measurement point pairs are averaged using a statistical method, so that the resulting average value can be determined as the decisive dynamic rigidity $k_{dyn}$.

Alternatively, or in addition, a phase diagram can be created by computer for contact force F and contact path s, as a function of time t. For the part of the phase diagram representing a load phase, in which the pressure of the contact element against the soil is increasing, an average gradient dF/ds is formed that represents the dynamic rigidity $k_{dyn}$.

For the determination of contact surface parameter α:

As already stated above, in order to determine the dynamic modulus of deformation $E_{v,dyncompaction}$ a contact surface parameter α is also required in order to take into account the actual contact surface of the contact element with the soil. Advantageously, contact surface parameter α is determined on the basis of a calculated position of a force application point of contact force F.

The contact element, in particular a soil contact plate in a vibrating plate or vibrating tamper, has a base surface that is in contact with the soil when the soil compaction device is at a standstill. However, during operation, during which the method according to the present invention is intended to be applied, as a rule it is no longer the case that the entire base surface of the contact element is involved in the transmission of the contact force; rather, only a partial surface thereof, namely the actual contact surface, participates in this transmission.

Due to the forward movement, characterized by cyclical airborne phases of the contact element, and the concomitant oblique position of the soil contact element relative to the surface of the soil being compacted, but also due to an oblique position of the surface itself, only a part of the underside of the contact element is in contact with the soil, while the rest of the underside of the contact element extends into the air. In practice, this can mean that, in a soil compaction device having a contact element that has a rectangular base surface that, during standstill, completely contacts the soil, during operation the actual contact surface is less than one-third of the base surface. The actual contact surface can then also be rectangular, triangular, or can have some other geometry, but can be significantly smaller than the base surface. The contact surface also need not be flat, as in standardized plate load methods, but rather can be concave or convex in the various directions (axes). In addition, within the momentary actual contact surface there may be regions in which, due to the momentary speed distribution on the contact element, a small transmission, or no transmission at all, of contact forces takes place. These regions must be taken into account in the determination of the relevant contact surface.

Because the size of the momentary actual contact surface has a decisive influence on the magnitude of the transmissible contact forces (given a larger contact surface, a larger contact force can be transmitted, assuming otherwise equal, isotropic soil characteristics), this size must be taken into account in the determination of the moduli of deformation.

Because the actual contact surface during a time interval under consideration in an exciter vibration cycle does not have to be situated symmetrically relative to the base surface of the contact element, but rather can be for example situated in a rear area (relative to the main direction of travel of the soil compaction device) of the contact element, the contact force F resulting from the soil contact tension acts not at the center of gravity of the base surface of the contact element, but rather at some other location, in particular at or in the vicinity of a center of gravity of the actual contact surface. Due to this deviation of the two centers of gravity, or deviation of the force application point from the center of gravity of the contact element, additional forces and moments act on the contact element that must be taken into account in the determination of the soil parameters.

The size and geometry of the contact surface change during the contact. If, for example, a rectangular contact element contacts the soil with a corner (forming a triangular contact surface) at the beginning of a contact phase, this triangular surface will at first become larger due to penetration. The inclination of the contact element will subsequently change in such a way that its contact center of gravity (contact surface and force) will be displaced during the penetration. At first it will move toward the center of gravity of the contact element. However, under some conditions the contact center of gravity can also migrate past the center of gravity of the contact element. In the extreme case, the contact element will switch to the opposite corner within an exciter vibration period.

Due to the eccentric force application point, the contact element experiences an additional rotational acceleration that counteracts the mass inertia of the contact element.

It has turned out that contact surface parameter α can advantageously be determined according to the following equation:

$$\alpha = \frac{1}{\gamma \cdot r_{hyd}} \tag{9}$$

where γ is a value in a range from 1.5 to 2.7, in particular is 2.1, and $r_{hyd}$ represents the hydraulic radius of comparison, and can be calculated from the actually effective contact surface $A_C$ according to the equation:

$$r_{hyd} = \sqrt{\frac{A_c}{\pi}} \tag{10}$$

Here, in order to determine contact surface parameter α the center of gravity of the actual contact surface of the contact element with the soil can be determined, which itself is determined from a force application point of contact force F. Contact force F is a surface load that acts on the contact surface of the contact element. It can be modeled by a resultant force that is applied at the resultant force application point. This force application point can be regarded, in a first approximation, as identical to the center of gravity of the actual contact surface. In order to correct the deviation of the actual force application point from the center of gravity of the contact surface, a correction factor can be introduced that is determined for example by means of simulation.

In a specific embodiment of the present invention, the movement of the contact element during soil contact is acquired by measurement sensors. On the basis of the information determined by the measurement sensors, and on the basis of contact force F, the position and dimension of the actual contact surface, situated within the base surface of the contact element, and/or the force application point of the resultant contact force can be determined.

The measurement sensors should be sensors that are capable of acquiring the linear and/or rotational movements of the contact element relative to various degrees of freedom.

A measurement sensor can be provided with which a pitch rotational acceleration, caused by contact force F, of the contact element is determined relative to a pitch axis (y axis) that stands transverse to the direction of travel of the soil compaction device.

In some circumstances, the pitch or roll acceleration (about the x axis) caused by the contact force must be calculated from the measured rotational accelerations, with knowledge of the moment of excitation. Analogously, in order to acquire a roll rotational acceleration of the contact element relative to a roll axis (x axis) extending in the direction of travel, a suitable measurement sensor can also be provided. The pitch axis and the roll axis each preferably pass through the center of gravity of the contact element. In order to measure the pitch and roll rotational accelerations, however, it is also possible to use three sensors that are not situated on one line, but whose measurement direction is oriented in the direction of the contact normals (as already described above).

In addition, it can be useful if, in order to measure a translational movement of the contact element in the direction of contact force F, a corresponding measurement sensor is present.

On the basis of the movements of the contact element measured by the measurement sensors, in particular on the basis of the rotational accelerations about the pitch and roll axis, three rotational impulse balances can be set up about the pitch axis and about the roll axis, from which the contact torques, caused by contact force F, about the pitch axis and the roll axis can be determined, taking into account the exciting torques, due e.g. to an exciter and the internal moments to the rest of the machine.

On the basis of the contact torques, determined in this way, and the already-known contact force F, the lever arms of contact force F relative to the pitch axis and to the roll axis, and thus the position of the force application point of contact force F, can be determined.

As a first approximation, the position of the force application point of the contact force can be regarded as the position of the center of gravity of the contact surface, so that in this way the position of the surface center of gravity is also known.

On the basis of the position of the center of gravity of the contact surface, or on the basis of the force application point and a prespecified relation, contact surface parameter $\alpha$ can be determined. The relation between contact surface parameter $\alpha$ and the position of the surface center of gravity, or of the force application point, can be determined in advance by the manufacturer of the soil compaction device through trials, in order to obtain a diagnostically effective equation. The specification of this relation can be stored in the form of a table, or as an equation for calculation.

In this way, contact surface parameter $\alpha$ can be determined during each compaction cycle of the contact element, and can be constantly adapted as a function of the size or position of the contact surface.

After both the contact surface parameter $\alpha$ and the dynamic rigidity $k_{dyn}$ have been determined in this way, dynamic modulus of deformation $E_{V,dyncompaction}$ can be determined according to the formula stated above.

If required, calibration measurements can be used to create a connection between dynamic modulus of rigidity $E_{V,dyncompaction}$ determined in this way and the moduli of deformation that can be determined using conventional measurement modules. For example, as a function of particular soil conditions tables can be created that permit the dynamic modulus of rigidity determined using the method according to the present invention to be transferred to other moduli of deformation that have been determined using standardized measurement methods.

According to the present invention, a soil compaction device is also indicated having a vibration exciter driven by a drive, a contact element charged by the vibration exciter that, during a vibration cycle, contacts the soil in phases or constantly, and is capable of briefly lifting off of the soil being compacted, and having a measurement system for determining a soil parameter that has at least one measurement sensor for acquiring a movement characteristic of the contact element. According to the present invention, the soil compaction device is characterized in that the measurement system is operated according to the above-indicated method of the present invention.

Advantageously, the soil compaction device is a vibrating plate or a tamper. However, an application to rollers is also possible in principle.

These and additional features and advantages of the present invention are explained in more detail below on the basis of an example, illustrated by the accompanying Figures.

BRIEF DESCRIPTION OF THE DRAWINGS

FIG. 1*a*) shows a schematic side view of a vibrating plate having a contact element, a vibration exciter, and an acceleration sensor;

FIG. 1*b*) shows the contact element of FIG. 1*a*) with a schematic representation of the imbalance shafts of the vibration exciter;

FIG. 2 shows a perspective view of the contact element of FIG. 1;

DETAILED DESCRIPTION OF THE PREFERRED EMBODIMENT

Figure 3:
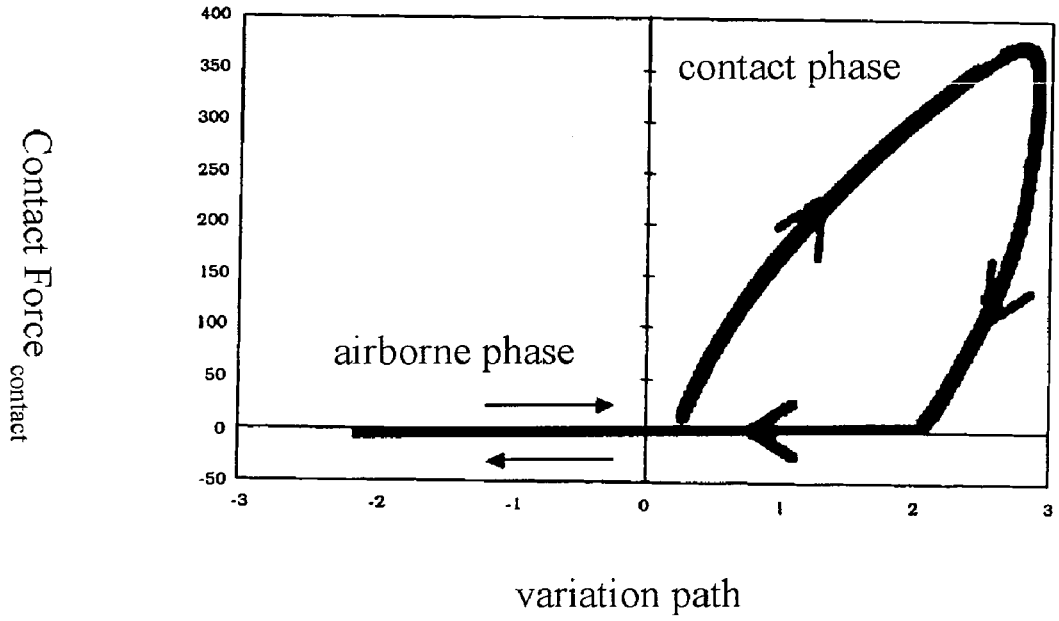
FIG. 3 shows a phase diagram indicating the contact force $F_{contact}$ and the vibration path s over time.

FIG. 1 shows, in a highly simplified schematic representation, a vibrating plate acting as a soil compaction device, having a contact element 1. Contact element 1 can also be, in a similar manner, a component of a vibrating tamper. The contact element, acting as a soil contact plate in this way, transfers, in a known manner, vibration forces produced by a vibration exciter 2 into the soil being compacted.

As is shown in FIG. 1*b*), vibration exciter 2 can be made up, in a known manner, of two imbalance shafts 3 that are capable of rotation in mutually opposite directions, and whose phase position to one another can be adjusted in order to achieve steerability, or change of direction, of the soil compaction device during traveling operation.

Contact element 1 is connected via a spring device 4 to an upper mass 5 so as to be capable of motion. A drive for vibration exciter 2 is standardly housed in upper mass 5. Moreover, FIG. 1*a*) shows a measurement sensor 6 that can be formed for example by an acceleration sensor. Measurement sensor 6 can be attached to vibration exciter 2, or can also be attached directly to contact element 1.

FIG. 2 shows a part of the design of FIG. 1*a*) in a perspective view.

Here, contact element 1 is shown in a highly simplified manner as a rectangular plate. Instead of a single measurement sensor 6, six measurement sensors 7, which can likewise be realized as acceleration sensors, are situated on contact element 1.

In addition, FIG. 2 shows a pitch axis 8 (y axis) that extends transverse to a direction of travel X, and a roll axis 9 (x axis) that extends in direction of travel X. Pitch axis 8 and roll axis 9 intersect at a center of gravity 10 of contact element 1. Acceleration sensors 7 are each situated at a distance from pitch axis 8 and roll axis 9 in order to be able to acquire rotational movements relative to pitch axis 8 and to roll axis 9, in particular angles of rotation or rotational accelerations.

The present invention also relates to a measurement method for determining a dynamic modulus of deformation of the soil being compacted at that moment by the soil compaction device. For this purpose, the movement characteristic of contact element 1 is measured and is evaluated in suitable form, as described below. However, because the measurement method has also already been explained in detail above, in the following only the essential aspects of the measurement methods are summarized.

The dynamic modulus of deformation is determined by the equation:

$$E_{v,dyncompaction} = \alpha - \frac{\Delta F_{contact}}{\frac{\Delta s_{contact}}{k_{dyn}}} \tag{1}$$

Here, $k_{dyn}$ is the dynamic rigidity of the soil. Contact surface parameter at takes into account, as a geometric factor, the characteristic size of the contact surface, and in particular the deviation of the position of the force application point relative to the overall base surface of the contact element. Both dynamic rigidity $k_{dyn}$ and also contact surface parameter cl can be determined during each load phase, so that a constantly current evaluation of these parameters, and thus of dynamic modulus of deformation $E_{V,dyncompaction}$, is possible.

In order to determine dynamic rigidity $k_{dyn}$, first contact force $F_{contact}$ and the path $S_{contact}$ traveled by contact element 1 during the contact phase, i.e. during contact with the soil being compacted, must be determined.

Contact force $F_{contact}$ is determined from the center of gravity principle relative to a coordinate system fixed on contact element 1. For this purpose, in addition to the acceleration of the center of gravity and the known mass of the contact element, the direction and magnitude of the exciting forces produced by vibration exciter 2, the direction and magnitude of the internal forces to the rest of the machine, the weight forces, and the normal acceleration forces resulting from the rotational speeds must be determined.

In particular, contact force $F_{contact}$ is calculated in simplified form for the case of the vibration plate shown in FIG. 1, as:

$$F_{contact}=m_L\cdot\ddot{z}_L-F_{ECC} \tag{5}$$

where $m_L$ is the mass of contact element 1, $\ddot{z}_L$ is the acceleration of contact element 1 in the direction of the contact normals, and $F_{ECC}$ is the exciting force of vibration exciter 2 charging contact element 1.

Translational acceleration $\ddot{z}_L$ of contact element 1 in the direction of the normal to the contact surface can be measured for example via measurement sensor 6 (acceleration sensor) in center of gravity 10 of contact element 1 (cf. FIG. 1*a*).

Alternatively, the translational and rotational accelerations in the contact normal direction and in the direction of the pitch and roll axes can also be measured with the aid of the six measurement sensors 7 (acceleration sensors) attached for example around center of gravity 10 of the contact element, in the manner shown in FIG. 2.

In addition, the acceleration in the direction of the contact normals can also be determined in contactless fashion, for example using optical laser sensors, or with the aid of the Doppler effect, corresponding measurement sensors 6*a* preferably being attached to upper mass 5 of the soil compaction device for this purpose.

The exciting force $F_{ECC}$ required for the calculation of contact force $F_{contact}$ in the above equation can be calculated in simplified fashion using the following equation:

$$F_{ECC}=EM\cdot\Omega^2\cdot\cos(\phi_{Phase}/2)\cdot\cos(\Omega\cdot t)$$

where EM is the resultant mass of rotating imbalance shafts 3, Ω is the exciting frequency of vibration exciter 2, and $\phi_{Phase}$ represents the phase angle between the two imbalance shafts 3.

Phase angle $\phi_{Phase}$ can be varied as a function of the operator settings. It relates to the relative position of the two imbalance shafts 3 to one another, and can therefore be modified according to the operator's desired direction of travel (forward or backward). A measurement of phase angle $\phi_{Phase}$ is possible for example using inductive or capacitive proximity switches or Hall sensors. It is also possible to set the phase position of imbalance shafts 3 using a regulating valve, so that reliable information about phase angle $\phi_{Phase}$ is also available.

If, for the time elapsed during a load cycle, contact force $F_{contact}$, calculated according to equation (5), is plotted over vibration path s, the typical contact force/vibration path phase diagram shown in FIG. 3 is obtained. FIG. 3 distinguishes two phases of a movement cycle of contact element 1, namely an airborne phase (also called a flight phase), and a contact phase that has a load phase and a relief phase. During the airborne phase, contact element 1 is in the air over the soil being compacted, while in the contact phase a mutual action takes place between contact element 1 and the soil.

The point at which vibration path s=0 is regarded as the null point. Starting from this point, the imbalance effect of vibration exciter 2 presses contact element 1 into the soil, so that, corresponding to the climbing branch (cf. direction of arrow in FIG. 3), as the vibration path increases an increase in contact force $F_{contact}$ takes place. After a maximum has been reached, contact element 1 is relieved of load due to the imbalance action, so that the phase curve reaches the decreasing branch of the contact phase, until finally there is no longer contact with the soil (at s=2 in FIG. 3).

The imbalance action lifts contact element 1 off the soil being compacted, and contact element 1 moves through the air over the soil, with no contact and therefore no contact force.

After a change in the direction of the vibration, contact element 1 again reaches the null position in the airborne phase, so that a new compaction cycle begins.

The vibration path s in the contact phase is designated contact path $s_{contact}$. It can be computed through double integration of the acceleration of the contact element. As explained above, the translational and rotational movement components should be taken into account here, i.e. during the integration as well.

For the determination of the dynamic rigidity $k_{dyn}$ of the soil, a plurality of measurement point pairs (contact force F, contact path s) can be determined in the load phase, and their gradient dF/ds can be determined. For this purpose, for example the curve can be approximated by a polynomial, using the least squares method. The gradient of the approximated curve can then be analytically calculated fairly easily from the polynomial coefficients.

The dynamic rigidity $k_{dyn}$ is then determined by averaging the various gradients over the overall load phase, so that finally for a load cycle a $k_{dyn}$ value can be found, as a measure of the dynamic rigidity, that represents an essential portion of the dynamic modulus of deformation $E_{V,dyncompaction}$ according to equation (1).

In order to determine contact surface parameter α, first the following set of problems must be noted:

FIG. 4*a*) shows, in simplified form, soil contact element 1 during operation, compacting soil 11. Due to the action of vibration exciter 2, contact element 1 is positioned obliquely relative to soil surface 11, so that only a rear part of contact element 1 contacts soil 11. Correspondingly, FIG. 4*a*) shows a contact surface 12 that reproduces the actual contact of contact element 1 with soil 11. In contact surface 12, contact forces 13 act as surface load.

In FIG. 4*b*), contact forces 13 are combined as resultant contact force 14, which acts in the direction normal to the contact surface at a force application point 15, and which corresponds to the above-named contact force $F_{contact}$. Force application point 15, at which contact force 14 is applied to contact element 1, has distance a from center of gravity 10 of the contact element.

For center of gravity 10 of contact element 1, the mass of contact element 1 and of vibration exciter 2 are taken into account.

It can be seen clearly that force application point 15 does not coincide with a center of gravity of a base surface of contact element 1 that would result if contact element 1 was completely in contact with the soil. Rather, contact force 14 acts asymmetrically, or eccentrically, on the center of gravity of the surface of contact element 1, and also on the overall center of gravity 10 of contact element 1.

Figure 4:
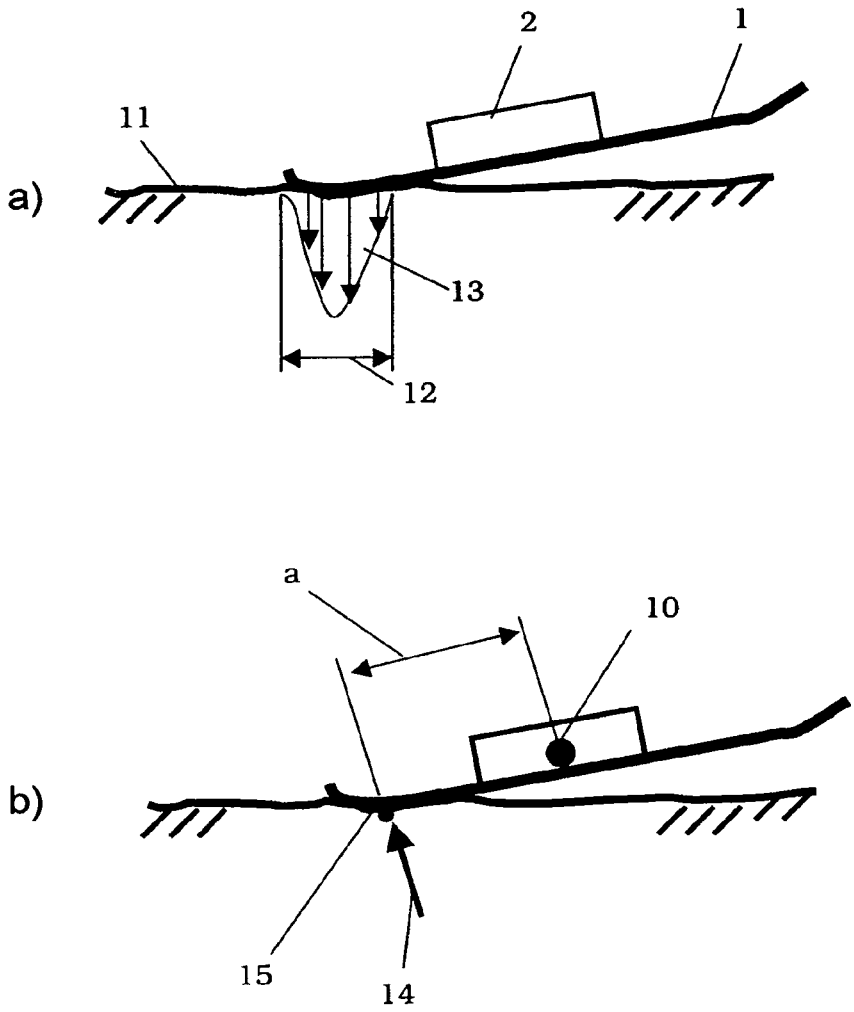
FIGS. 4*a*) and *b*) show a contact element during operation with a small contact surface.
Figure 5:
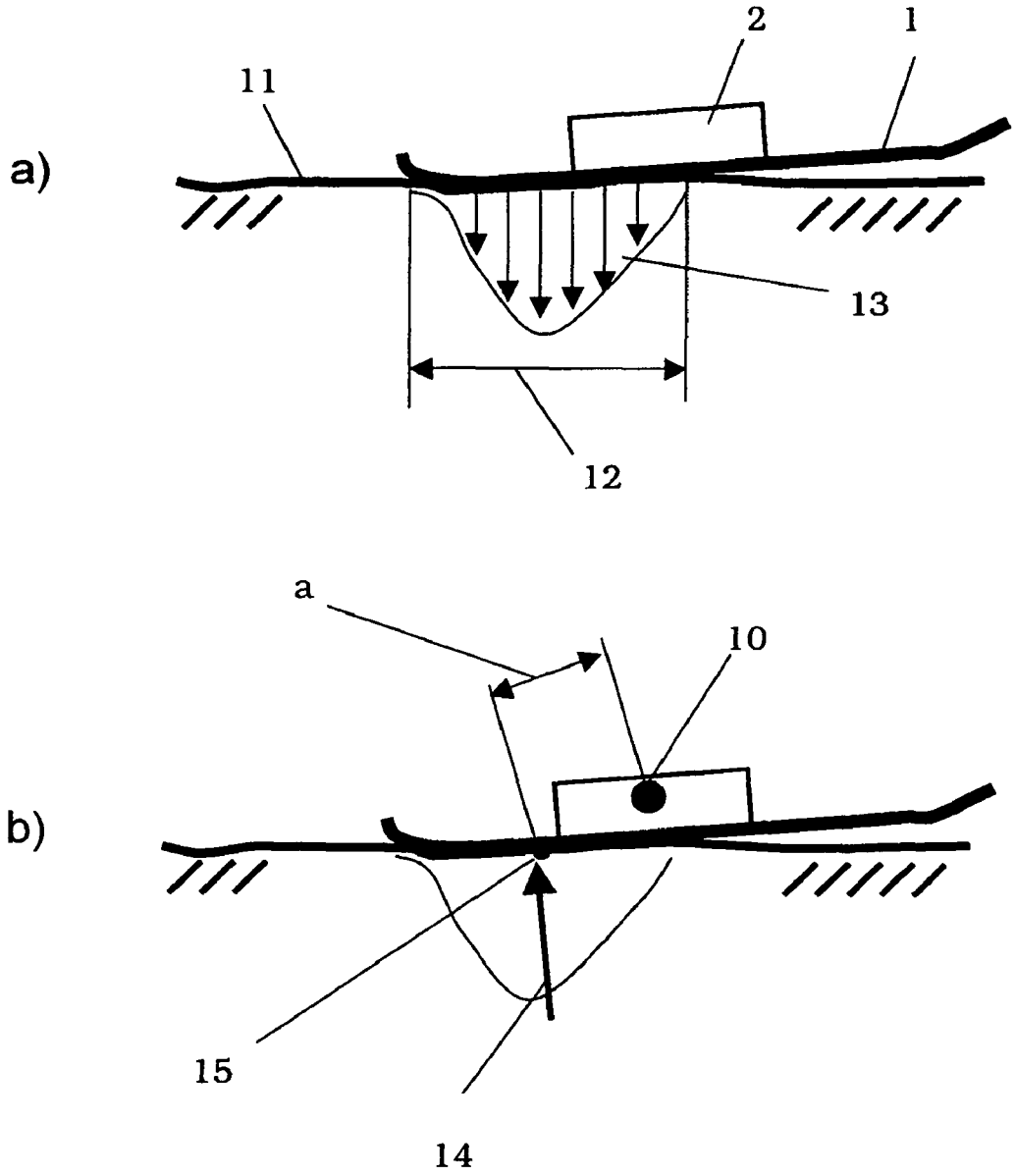
FIGS. 5*a*) and *b*) show a contact element during operation with a large contact surface.

Analogously to FIG. 4, FIG. 5 shows a contact element 1 that acts on soil 11, contact surface 12 being significantly larger here (see FIG. 5*a*)). This is the case for example if the soil is softer than in FIG. 4*a*).

As can be seen from FIG. 5*a*), force application point 15 of resultant contact force 14 is then moved closer to center of gravity 10, so that distance a is reduced.

In order to determine contact surface parameter α, the position of force application point 15 of contact force 14 relative to the position of center of gravity 10 of contact element 1 can now for example be used. This approach is based on the consideration that given almost constant soil rigidity along the compaction path, the center of gravity of a large contact surface 12 (FIG. 5*a*)) is situated closer to center of gravity 10 of contact element 1 than is the case given a smaller contact surface (FIG. 4*a*)).

In order to determine the center of gravity of actual contact surface 12, first the rotational accelerations, caused by contact force 14, about the pitch and roll axes (8 and 9 in FIG. 2) are determined. From the knowledge of the respective momentary resultant contact force 14, and the torques caused thereby, force application point 15 can be calculated. For this purpose, the translational movement, the pitch movement, and the roll movement of contact element 1 must be determined using measurement sensors. For this purpose, for example measurement sensors 7 shown in FIG. 2 are suitable.

The rotational movements that occur as a result of the contact, in particular the pitch and roll movement of contact element 1, can be determined from the rotational impulse balances in the pitch and roll direction with knowledge of the mass inertia moments (known a priori) of the contact element on contact element 1, so that the contact torques, caused by contact force 14, about pitch axis 8 and about roll axes 9, can be calculated, as is explained below.

From the contact torques, with knowledge of contact force 14, or $F_{contact}$, the lever arms of contact force 14 in the roll and pitch direction, and thus the position of force application point 15, can in turn correspondingly be determined. Here, the position and geometry of the contact surface are inferred from the knowledge of the center of gravity of the contact force. Because the soil may be uneven, this is not unambiguously possible in all cases. However, it is technically sufficient to create a relation through suitable trials and statistical evaluation of the load cycles.

Figure 6:
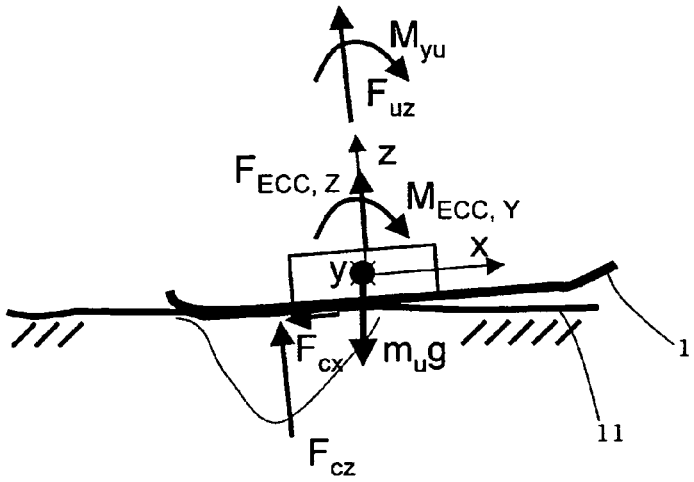
FIG. 6 shows a schematic representation of forces and moments on a contact element (simplified)

The relations are shown in simplified form in FIG. 6 for the case of a vibrating plate.

In general, in order to calculate contact surface parameter at first the position of the theoretical force application point 15 must be calculated:

Using the principle of conservation of angular momentum, the rotational accelerations in the center of gravity of a moved body, or of a coordinate system fixed in the center of gravity, is calculated from the sum of the acting external torques, according to:

$$I_X\cdot\ddot{X}+(I_Z-I_Y)\cdot\dot{\Phi}\dot{N}-(\ddot{N}+\dot{X}\dot{\Phi})\cdot I_{XZ}+(\dot{N}^2-\dot{\Phi}^2)\cdot I_{YZ}+(\dot{X}\dot{N}-\ddot{\Phi})\cdot I_{XY}=\Sigma M_X$$

$$I_Y\cdot\ddot{\Phi}+(I_X-I_Z)\cdot\dot{N}\dot{X}-(\ddot{X}+\dot{\Phi}\dot{N})\cdot I_{XY}+(\dot{X}^2-\dot{N}^2)\cdot I_{ZX}+(\dot{\Phi}\dot{X}-\ddot{N})\cdot I_{YZ}=\Sigma M_Y$$

$$I_Z\cdot\ddot{N}+(I_Y-I_X)\cdot\dot{X}\dot{\Phi}-(\ddot{\Phi}+\dot{X}\dot{N})\cdot I_{YZ}+(\dot{\Phi}^2-\dot{X}^2)\cdot I_{XY}+(\dot{N}\dot{\Phi}-\ddot{X})\cdot I_{ZX}=\Sigma M_Z \quad (11)$$

The moments of inertia of contact element 1, $I_X$, $I_Y$, $I_Z$, etc., can be determined from CAD data, or may be determined experimentally. The rotational accelerations can be determined using suitably positioned acceleration sensors 7 as described above.

The components of the applied torques result from internal moments $M_U$ to the rest of the soil compaction device (upper mass), the moments $M_C$ caused by the soil contact force, and the moments $M_{ECC}$ exerted by vibration exciter 2 about the respective axes x, y, and z, according to:

$$\Sigma M_X=M_{C,X}+M_{ECC,X}+M_{U,X}$$

$$\Sigma M_Y=M_{C,Y}+M_{ECC,Y}+M_{U,Y}$$

$$\Sigma M_Z=M_{C,Z}+M_{ECC,Z}+M_{U,Z} \quad (12)$$

For torques $M_{C,1}$ effected by soil contact force components $F_{C,1}$, the following may be used:

$$M_{C,X}=F_{C,Z}\cdot r_{C,Y}-F_{C,Y}\cdot r_{C,Z}$$

$$M_{C,Y}=-F_{C,Z}\cdot r_{C,X}-F_{C,X}\cdot r_{C,Z}$$

$$M_{C,Z}=F_{C,Y}\cdot r_{C,X}-F_{C,X}\cdot r_{C,Y} \quad (13)$$

where $r_C$ represents the coordinates of the force application point relative to the center of gravity of contact element 1.

$r_C$ are therefore the coordinates that define the position of force application point 15 relative to the center of gravity of contact element 1. They can be determined by solving the above equation system (13), taking into account equation systems (11) and (12).

The following thus results for coordinates $r_C$ of force application point 15:

For the case of a contact element whose excitations lie in the xz plane of the center of gravity (i.e., $F_{C,Y}\approx 0$), there results for the lever arms:

$$r_{C,Y}=\frac{M_{C,X}}{F_{C,Z}} \quad (14)$$

$$r_{C,X}=\frac{-[M_{C,Y}+F_{C,X}\cdot r_{C,Z}]}{F_{C,Z}} \quad (15)$$

$r_{C,Z}$ is the z coordinate of the underside of contact element 1, and is known e.g. from CAD data.

For the case in which the vibration exciter has two shafts rotating in opposite directions, having equally large imbalance masses, whose axes of rotation have the same orientation as the y axis of contact element 1, and whose phase position to one another is adjustable, the components of the exciting torque about the axis (pitch moment) $M_{ECC,Y}$, relative to the stationary coordinate system on the contact element can be calculated as a function of time t in simplified form using the following equation:

$$M_{ECC,Y}=EM\cdot\Omega^2\cdot[e_Z\cdot(\sin\phi_V+\sin\phi_M)-r_S\cdot(\cos\phi_V+\cos\phi_V)] \quad (16)$$

EM is the resultant mass of rotating imbalance mass 3, and Ω is the exciting frequency of vibration exciter 2. The angles $\phi_V$ and $\phi_H$ represent the momentary phase angles of the front and rear exciter shafts relative to the vertical (z axis). They can be determined separately, for example using proximity switches on each exciter shaft. $r_S$ represents half the distance between the exciter shaft midpoints, and can be taken from CAD data or can be measured directly. $e_Z$ is the distance of the exciter shaft center of gravity from the overall center of gravity of the lower mass in the z direction, and can likewise be determined from CAD data.

Figure 7:
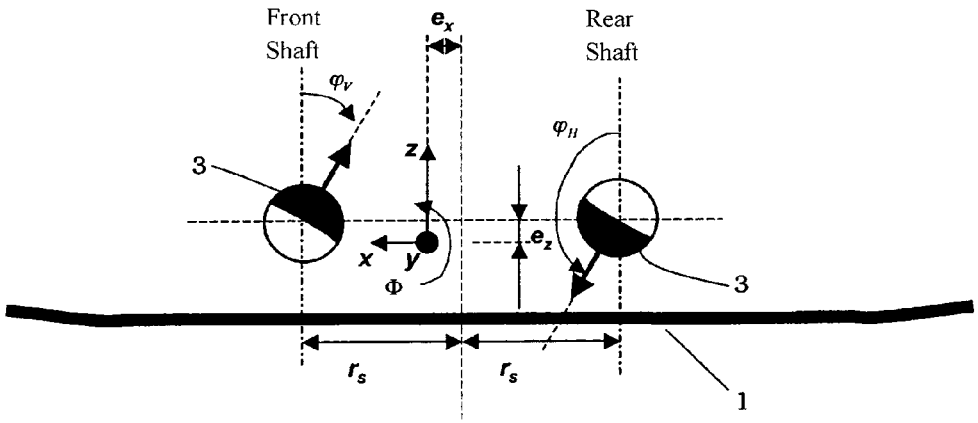
FIG. 7 shows geometric relations on a contact element with a two-shaft vibration exciter.

The relations are shown in FIG. 7.

For the case in which the center of gravity of the two exciter shafts in the x and y direction agrees with the center of gravity of the contact element, the exciter does not produce any additional exciting torques about the x axis and about the z axis. The torque components $M_{ECC,X}$ and $M_{ECC,Z}$ are then zero. For all other cases, the torques can of course be calculated by computer from the momentary position of the imbalance masses.

In the following, as an example a method is explained for the approximate determination of actual contact surface 16 for the case of a rectangular contact element 1 and a flat one: Due to the pitch and roll movement of the contact element, contact will always begin from a corner or edge of the contact element.

Figure 8:
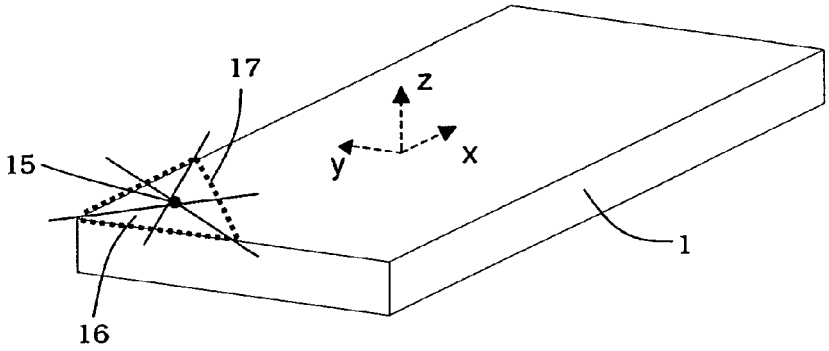
FIG. 8 shows a contact element having a triangular contact surface.

FIG. 8 shows a schematic perspectival view of a contact element 1 whose travel direction is in the direction of the x axis. On contact element 1, a triangular contact surface 16 with straight boundary edges is shown in broken lines. The outer boundary lines here are known from the known outer geometry of contact element 1.

The missing inner boundary line (contact edge 17), which in the ideal case is straight, is now calculated from the condition that force application point 15 is situated for example in the center of gravity of the triangle forming contact surface 16.

Figure 9:
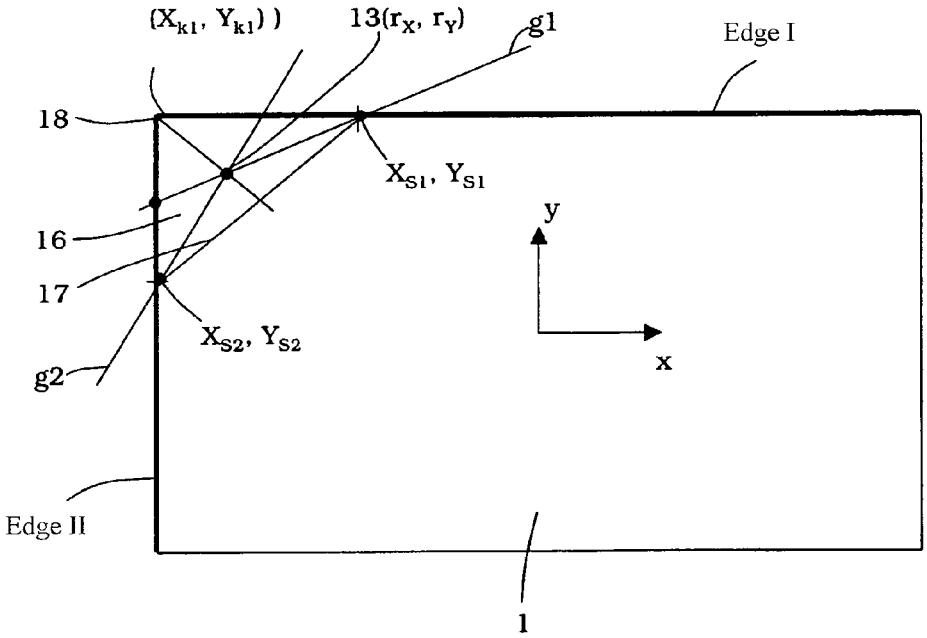
FIG. 9 shows the contact element of FIG. 8 in a top view.

FIG. 9 shows an example of the construction of the missing inner edge of contact surface 16; in this example, the contact begins at a corner 18 (point of intersection of edges I and II of contact element 1).

From the knowledge of the center of gravity of the surface (which should be identical to force application point 15, so that the above-determined coordinates $r_C$ hold) and the condition that the two straight lines $g_1$ and $g_2$ intersect in the center of gravity of the surface, and given the known coordinates of the two edges I and II of contact element 1, a system of two equations can be created and solved for the desired unknown intersection points ($x_{s1}$, $y_{s1}$) and ($x_{s2}$, $y_{s2}$) of the inner edge of triangular contact surface 16. The procedure is analogous if the contact begins at a different corner of contact element 1.

Figure 10:
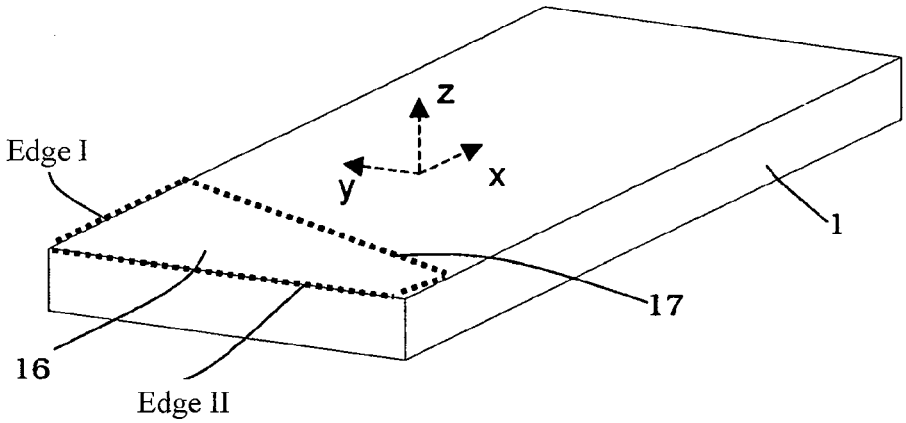
FIG. 10 shows a contact element having a quadrangular contact surface.

FIG. 10 shows a case in which one of the points of intersection calculated in this way according to FIG. 9 goes beyond the actual geometry, i.e. in particular goes past the relevant edge of contact element 1. In this case, the calculation of inner contact edge 18 is then carried out again, under the assumption that contact surface 16 is now quadrangular. For quadrangular contact surface 16, from the known position of the surface center of gravity (coordinates $r_C$ of force application point 15) and the geometric construction rules, an equation system can now likewise be set up and solved in order to determine the unknown points of intersection with the contact element edges (edges I and II).

Figure 11:
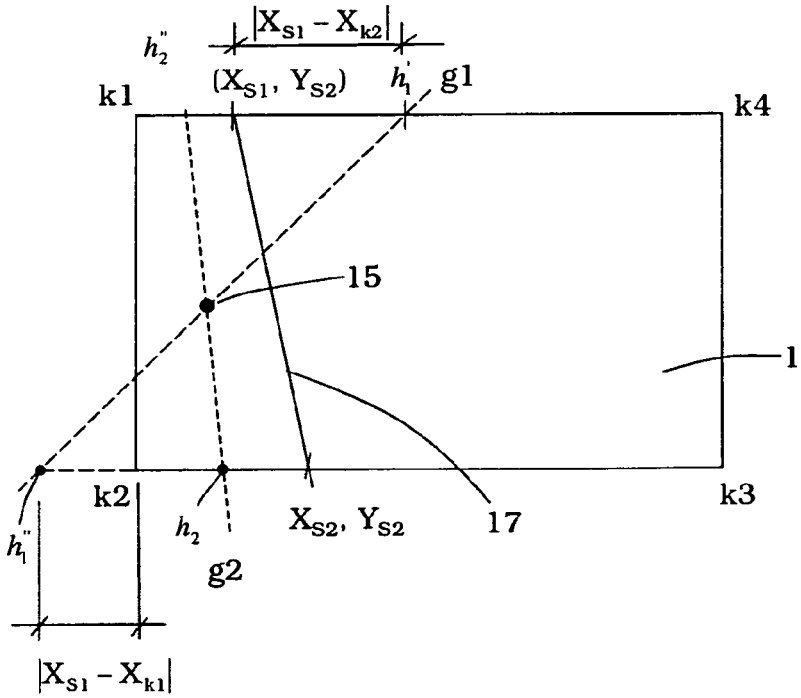
FIG. 11 shows the contact element of FIG. 10 in a top view.

FIG. 11 shows the geometrical determination of center of gravity 15 of a trapezoidal, quadrangular surface.

Figure 12:
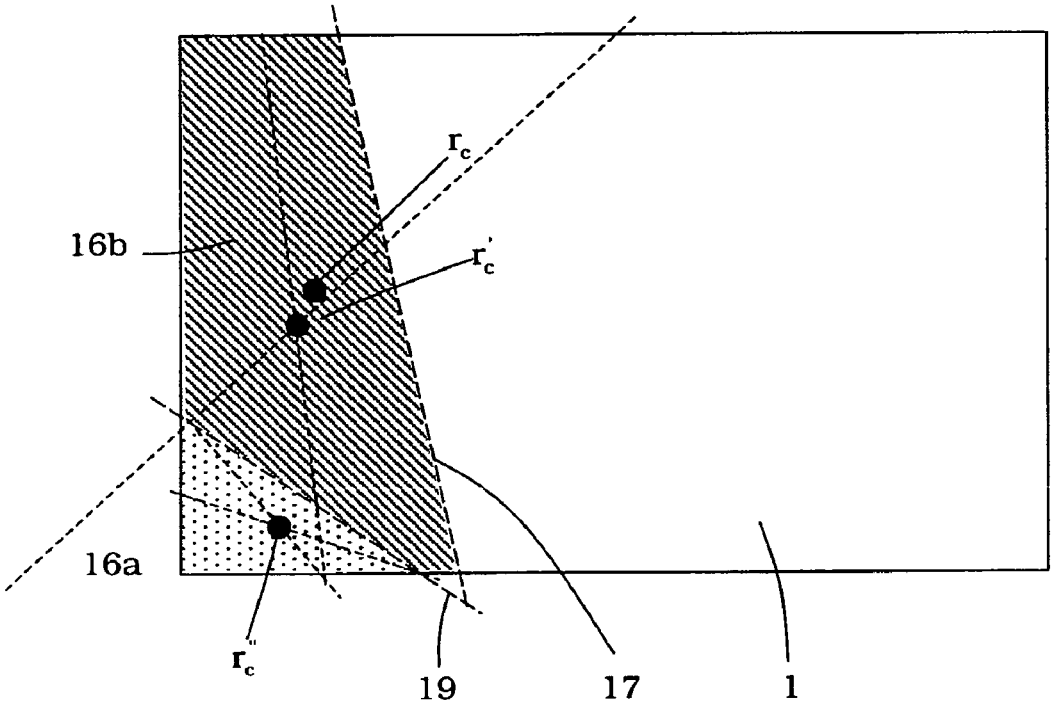
FIG. 12 shows a top view of a contact element having a pentagonal contact surface.

FIG. 12 shows a case in which, on the basis of the superposition of the rotational and translational speed components in a part 16*a* (dotted surface) of contact surface 16, a speed distribution arises in which this part moves away from the soil. These surface portions should then be given lower value in the calculation of the actual contact surface 16, because there practically no soil contact forces, or only very low ones, are transmitted.

A speed zero line 19 runs between surface part 16*a*, which lifts off from the soil and is shown in dotted lines in FIG. 12, and surface part 16*b*, shown with hatching in FIG. 12*b*, which moves toward the soil and thus transmits soil contact forces.

The presence and the position of a zero line 19, at which the speed of the contact element in the normal direction changes its sign, can be calculated from the kinematic relations, given known translational and angular speed of the center of gravity of contact element 1. For the overall speed at a point ($r_x$, $r_y$) of contact element 1, given pure translational movement in the z direction and superposed pitch/roll movement, there results:

$$v_{P,z}=\dot{z}_S+\dot{X}\cdot r_y-\dot{\Phi}\cdot r_x$$

Setting the speed to zero then yields the relevant linear equation for speed zero line 19, according to:

$$r_y(r_x)=\frac{\dot{\Phi}\cdot r_x-\dot{z}_S}{\dot{X}}$$

Because speed zero line 19 is always a straight line, in the worst case there results a pentagon for the relevant contact surface (hatched surface 16*b*), as FIG. 12 shows. FIG. 12 shows the resulting contact surface when speed zero line 19 is close to a corner 20. Because the center of gravity of the triangular surface that is to be drawn away (dotted surface part 16*a*) is known, the center of gravity of dotted triangular surface 16*a* plus the hatched actual contact surface 16*b* can be calculated as a summed center of gravity. For the resulting quadrangular overall surface (surface parts 16*a* and 16*b*), the missing contact edge 17 can then be calculated again according to the method described above.

The definition of the one-dimensional modulus of elasticity in soil mechanics is as follows:

$$E = (1 - \upsilon^2) \cdot \frac{1}{2 \cdot r} \frac{\Delta F}{\Delta s}$$

Here the soil is loaded by a circular, rigid plate having radius r and constant distribution of pressure. F describes the applied force, and s describes the sink-in depth. For cohesionless soils, Poisson's ratio $\upsilon$ is approximately constant, and is for example always used with $\upsilon$=0.212 in the evaluation of the static load plate trial.

Gradient $\Delta F/\Delta s$ was already determined above, so that for contact surface parameter $\alpha$ the following formulation is to be used (with $\upsilon$=0.212):

$$\alpha = \frac{1}{2,1 \cdot r_{hyd}}.$$

In this definition, the above-named value $\gamma$ is set to 2.1, which yields suitable results. However, it has turned out that Poisson's ratio $\upsilon$ can vary given different soil qualities. Correspondingly, the factor $\gamma$ can lie in a range from 1.5 to 2.7.

$r_{hyd}$ represents the hydraulic comparison radius, and can be calculated according to $$r_{hyd} = \sqrt{\frac{A_c}{\pi}}$$

from contact surface $A_C$ (reference character 16), whose determination was explained above.

In order to enable dynamic modulus of rigidity $E_{V,dyncompaction}$ to be compared with moduli of deformation determined using conventional, e.g. standardized, measurement methods, calibration measurements can be carried out, or calibration tables can be evaluated.

The method according to the present invention, or a soil compaction device such as a tamper or a vibrating plate operated using the method according to the present invention, make it possible to determine the soil rigidity, or the dynamic modulus of deformation of the soil, during compaction. The method is particularly well-suited for soil compaction devices in which the contact element executes relatively long airborne phases, and in which, due to significant rotational movement components, the contact force and the contact path often have unpredictable, changing directions. The method is also well-suited for taking into account different contact geometries or different effective actual contact surfaces. This is a significant difference from previously known measurement methods used in particular with soil compaction rollers, in which the contact surface and also the direction of the dominant contact force to the soil is essentially constant, or can be reliably predicted a priori.

Soil compaction devices having short airborne phases, or no airborne phases, can however also determine the soil rigidity and the dynamic modulus of soil deformation using the method according to the present invention.

Figure 13:
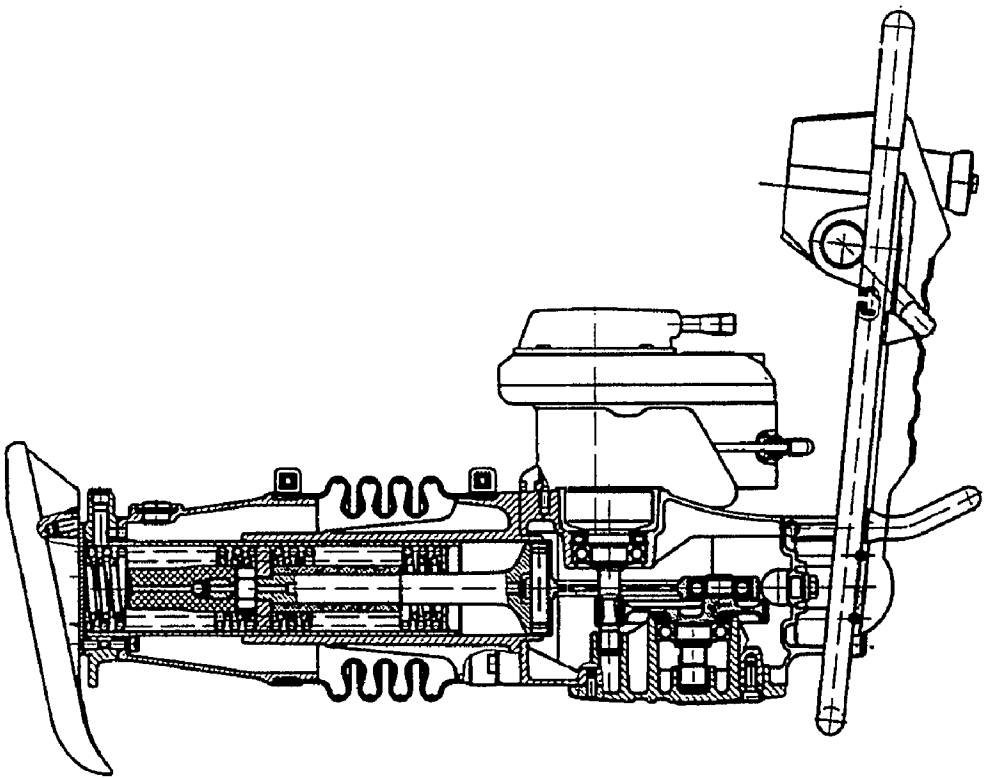
FIG. 13 shows a schematic side view of a vibrating tamper used as a soil compaction device.

FIG. 13 shows, in a side view, a typical vibrating tamper in which the method according to the present invention can be used.

Machines in which an essentially constant contact characteristic can be assumed (vibrating rollers) can also use the method described herein to determine the soil rigidity and the modulus of soil deformation.

The invention claimed is:

1. A method for determining a soil parameter using a soil compaction device that has a contact element charged with vibration for soil compaction, the method comprising:

exposing the contact element to a contact force $F_{contact}$ exerted by the soil, while traveling a contact path $s_{contact}$; and determining the soil parameter as a dynamic modulus of deformation $E_{V,\ dyncompaction}$, as follows:

$$E_{V,dyncompaction} = \alpha \cdot \frac{\Delta F_{contact}}{\frac{\Delta s_{contact}}{k_{dyn}}}$$

$\alpha$ being a contact surface parameter for taking into account the actual contact surface of the contact element with the soil;

$k_{dyn}$ being the dynamic rigidity of the soil, and being formed as a gradient of the contact force $F_{contact}$ and of the contact path $s_{contact}$.

2. The method as recited in claim 1, wherein spatial components $F_{C,i}$(where i=x,y,z) of the contact force $F_{contact}$ of the contact element to the soil are determined as:

$$F_{C,X} = m_U(\ddot{x}_S - \dot{y}_S \cdot \dot{N} + \dot{z}_S \cdot \dot{\Phi}) - F_{ECC,X} - F_{U,X} + m_U \cdot g \cdot \sin(\Phi) \cdot \cos(X)$$

$$F_{C,Y} = m_U(\ddot{y}_S - \dot{z}_S \cdot \dot{X} + \dot{x}_S \cdot \dot{N}) - F_{ECC,Y} - F_{U,Y} - m_U \cdot g \cdot \cos(\Phi) \cdot \sin(X)$$

$$F_{C,Z} = m_U(\ddot{z}_S - \dot{x}_S \cdot \dot{\Phi} + \dot{y}_S \cdot \dot{X}) - F_{ECC,Z} - F_{U,Z} + m_U \cdot g \cdot \cos(\Phi) \cdot \cos(X)$$

where $m_U$ is the mass of the contact element;

$\dot{x}_S$, $\dot{y}_S$, $\dot{z}_S$ are the translational speeds in the center of gravity of the contact element;

$\ddot{y}_S$, $\ddot{y}_S$, $\ddot{z}_S$ are the corresponding accelerations of the center of gravity of the contact element;

$\Phi$ is the pitch angle about the y axis;

X is the roll angle about the x axis;

$\dot{\Phi}$, $\dot{X}$, $\dot{N}$ are the corresponding angular speeds of the center of gravity of the contact element in the pitch, roll, and yaw directions (about the z axis);

$F_{U,i}$ is an internal force between the contact element and the rest of the soil compaction device;

$F_{ECC,i}$ is the exciting force of a vibration exciter that excites the contact element;

g is the gravitational acceleration.

3. The method as recited in claim 2, wherein the accelerations that are to be determined of the contact element are measured from the group $\ddot{y}_S$, $\ddot{y}_S$, $\ddot{z}_S$ by a plurality of acceleration sensors provided on the contact element.

4. The method as recited in claim 2, wherein the accelerations $\ddot{y}_S$, $\ddot{y}_S$, $\ddot{z}_S$ of the center of gravity of the contact element (1) are measured by at least one sensor (6*a*) that is provided on an upper mass (5) that is connected to the contact element (1) via a spring device (4).

5. The method as recited in claim 2, wherein the rotational accelerations $\ddot{\Phi}$, $\ddot{X}$, $\ddot{N}$ of the center of gravity of the contact element are measured by at least one sensor provided on the contact element;

the rotational speeds $\dot{\Phi}$, $\dot{X}$, $\dot{N}$ of the center of gravity of the contact element are determined by simple integration of the rotational accelerations $\ddot{\Phi}$, $\ddot{X}$, $\ddot{N}$ and that the pitch angle $\Phi$ and the roll angle X of the contact element are determined by double integration of the rotational accelerations $\ddot{\Phi}$, $\ddot{X}$, $\ddot{N}$ of the center of gravity of the contact element.

6. The method as recited in claim 2, wherein the exciting force $F_{ECC}$ is measured by a force measurement device provided between the vibration exciter and the contact element.

7. The method as recited in claim 2, wherein the vibration exciter has at least two equally large imbalance masses that are capable of rotation in mutually opposite directions, whose phase position to one another is adjustable, and whose axes of rotation are oriented parallel to a y axis of the contact element; and that the components of the exciting force $F_{ECC}$ are calculated using the following equations:

$$F_{ECC,X}(t)=EM\cdot\Omega^2\sin(\phi_{Phase}/2)\cdot\cos(\Omega\cdot t)$$

$$F_{ECC,Y}(t)=0$$

$$F_{ECC,Z}(t)=EM\cdot\Omega^2\cos(\phi_{Phase}/2)\cdot\cos(\Omega\cdot t)$$

where EM is the resultant mass of the rotating imbalance masses, $\Omega$ is the exciting frequency of the vibration exciter, and $\phi_{Phase}$ represents the phase angle between the two imbalance masses.

8. The method as recited in claim 1, wherein the soil compaction device is one of a vibrating plate and a vibrating tamper; and the contact force $F_{contact}$ is determined according to:

$$F_{contact}=m_U\cdot\ddot{z}_S-F_{ECC,Z}$$

where $m_u$ is the mass of the contact element, $\ddot{z}_S$ is the acceleration of the contact element in the direction of the contact normals, and $F_{ECC,Z}$ is the exciting force of a vibration exciter that charges the contact element.

9. The method as recited in claim 8, further comprising measuring the acceleration $\ddot{z}_S$ of the center of gravity of the contact element by an acceleration sensor provided on the contact element.

10. The method as recited in claim 8, wherein the acceleration $\ddot{z}_S$ of the center of gravity of the contact element is measured by a sensor that is provided on an upper mass that is connected to the contact element via a spring device.

11. The method as recited in claim 1, wherein the vibration exciter has two equally large imbalance masses that are capable of rotation in mutually opposite directions and whose phase position is predetermined and/or adjustable to one another; and that the exciting force $F_{ECC}$ is calculated by the following equation:

$$F_{ECC}=EM\cdot\Omega^2\cdot\cos(\phi_{Phase}/2)\cdot\cos(\Omega\cdot t)$$

where EM is the resultant mass of the rotating imbalance masses, $\Omega$ is the exciting frequency of the vibration exciter, and $\phi_{Phase}$ represents the phase angle between the two imbalance masses.

12. The method as recited in claim 1, wherein the contact path $S_{contact}$ is determined by:

determining the acceleration $a_{P,z}$ of a force application point P in the z direction using the equation $$a_{P,z}=\ddot{z}_S+\ddot{X}\cdot SP_Y-\ddot{\Phi}\cdot SP_X-(\dot{\Phi}^2+\dot{X}^2)SP_Z,\text{ and}$$

calculating the contact path $S_{contact}$ through double integration of the acceleration $a_{P,z}$.

13. The method as recited in claim 1, wherein for each of various points in time, a measurement pair is formed from the contact force $F_{contact}$ and the associated contact path $s_{contact}$.

14. The method as recited in claim 13, wherein a gradient $dF_{contact}/dS_{contact}$ is formed for each of those measurement point pairs during a load phase in which the contact element is increasingly pressed against the soil.

15. The method as recited in claim 13, wherein the gradients for each of the pairs of measurement points are averaged using a statistical method, and the resulting average value is identified as the dynamic rigidity $k_{dyn}$ of the soil.

16. The method as recited in claim 1, comprising forming a phase diagram as a function of time t for the contact force $F_{contact}$ and the contact path $s_{contact}$; and forming, for a part of the phase diagram that represents a load phase, during which the pressure of the contact element against the soil increases, an average gradient $dF_{contact}/dS_{contact}$ that represents the dynamic rigidity $k_{dyn}$ of the soil.

17. The method as recited in claim 1, wherein the contact surface parameter $\alpha$ is determined on the basis of a resultant position of a force application point of the contact force $F_{contact}$.

18. The method as recited in claim 1, wherein, in order to determine the contact surface parameter $\alpha$, a center of gravity of the actual contact surface of the contact element with the soil is determined, which center of gravity is in turn determined from a force application point of the contact force $F_{contact}$.

19. The method as recited in claim 18, wherein the force application point is independent of a center of gravity of a base surface of the contact element, and need not coincide therewith.

20. The method as recited in claim 18, wherein measurement sensors are used to acquire the movement of the contact element during contact with the soil; and on the basis of the information determined by the measurement sensors, as well as the contact force $F_{contact}$, the position and dimension of the actual contact surface, and/or of the force application point, within the base surface of the contact element is determined.

21. The method as recited in claim 18, wherein in order to determine the force application point of the contact force $F_{contact}$, a pitch rotational acceleration of contact element, caused by contact force $F_{contact}$, relative to a pitch axis that stands transverse to the direction of travel of the soil compaction device is determined by the measuring sensors, and a roll rotational acceleration of the contact element relative to a roll axis that extends in the direction of travel is determined by measurement sensors.

22. The method as recited in claim 21, wherein, on the basis of the movements of the contact element, measured by the measurement sensors, and on the basis of an evaluation of the principle of angular momentum about the pitch axis and about the roll axis, the contact torques, caused by the contact force $F_{contact}$ about the pitch axis and the roll axis, are determined.

23. The method as recited in claim 22, wherein, on the basis of the contact torques and the already-determined resultant contact force $F_{contact}$, lever arms are determined with respect to the pitch axis and the roll axis, and therewith the position of the force application point of the contact force $F_{contact}$ is determined.

24. The method as recited in claim 1, wherein the contact surface parameter α is determined by:

$$\alpha = \frac{1}{\gamma \cdot r_{hyd}}$$

where γ is a value in the range from 1.5 to 2.7 and $r_{hyd}$ represents the hydraulic comparison radius and is calculated according to:

$$r_{hyd} = \sqrt{\frac{A_c}{\pi}}$$

from an actually effective contact surface $A_C$ of the contact element with the soil.

25. The method as recited in claim 24, wherein in order to determine the effective contact surface $A_C$, a part of the outer boundary edge of the contact surface geometry is known, and the missing part of the contact surface $A_C$ is calculated from the knowledge of the center of gravity of the surface.

26. The method as recited in claim 1, wherein a translational movement of the contact element in the direction of contact force $F_{contact}$ is determined by the measurement pick-ups.

27. The method as recited in claim 1, wherein, on the basis of the position of the force application point of the contact force $F_{contact}$, the position of the center of gravity of the contact surface is determined.

28. The method as recited in claim 1, wherein the contact surface parameter α is determined on the basis of the position of the surface center of gravity or of the force application point.

29. A soil compaction device, comprising:

a vibration exciter driven by a drive;

a contact element, charged by the vibration exciter, for compacting the soil, the contact element being exposed to a contact force $F_{contact}$ exerted by the soil when the contact element travels along a contact path $s_{contact}$; and a measurement system for determining a soil parameter, the measurement system having at least one measurement sensor for acquiring a movement characteristic of the contact element, and wherein the soil parameter is determined as a dynamic modulus of deformation $E_{V,\ dyncompaction}$, as follows:

$$E_v r_{dyncompaction} = \alpha \cdot \frac{\Delta F_{contact}}{\frac{\Delta s_{contact}}{k_{dyn}}}$$

α being a contact surface parameter for taking into account the actual contact surface of the contact element with the soil; and $k_{dyn}$ being the dynamic rigidity of the soil, and being formed as a gradient of the contact force $F_{contact}$ and of the contact path $s_{contact}$.

30. The soil compaction device as recited in claim 29, wherein the soil compaction device is one of a vibrating plate and a tamper.

31. A soil compaction device, comprising:

means for driving a vibration exciter;

means for compacting the soil, the means for compacting being charged by the vibration exciter and being exposed to a contact force $F_{contact}$ exerted by the soil when the means for compacting soil travels along a contact path $s_{contact}$; and means for determining a soil parameter, the means for determining having at least one means for acquiring a movement characteristic of the means for compacting the soil, wherein the soil parameter is determined as a dynamic modulus of deformation $E_{v,\ dyncompaction}$, as follows:

$$E_v r_{dyncompaction} = \alpha \cdot \frac{\Delta F_{contact}}{\frac{\Delta s_{contact}}{k_{dyn}}}$$

where:

α is a contact surface parameter for taking into account the actual contact surface of the contact element with the soil; and $k_{dyn}$ is the dynamic rigidity of the soil and is formed as a gradient of the contact force $F_{contact}$ and of the contact path $s_{contact}$.

* * * * *